US005231924A

United States Patent [19]

Schneid

[11] Patent Number: 5,231,924

[45] Date of Patent: Aug. 3, 1993

[54] APPARATUS FOR THE VERTICAL ADJUSTMENT OF ROLLS

[75] Inventor: Josef Schneid, Vogt, Fed. Rep. of Germany

[73] Assignee: Sulzer-Escher Wyss GmbH, Ravensburg, Fed. Rep. of Germany

[21] Appl. No.: 831,714

[22] Filed: Feb. 5, 1992

[30] Foreign Application Priority Data

Feb. 7, 1991 [DE] Fed. Rep. of Germany ..... 4103620

[51] Int. Cl.[5] ..... B30B 3/04; D21G 1/02

[52] U.S. Cl. ..... 100/163 A; 100/168; 100/170

[58] Field of Search ..... 100/161, 162 R, 163 R, 100/163 A, 165, 168, 169, 170

[56] References Cited

U.S. PATENT DOCUMENTS

| | | | |
|---|---|---|---|
| 3,373,681 | 3/1968 | Jaegers | 100/170 X |
| 3,584,570 | 6/1971 | Sass et al. | 100/163 A |
| 3,942,434 | 3/1976 | Wenzel et al. | 100/168 |
| 3,948,166 | 4/1976 | Wenzel | 100/168 X |
| 4,823,690 | 4/1989 | Stotz | 100/163 A |
| 4,890,551 | 1/1990 | Dahl et al. | 100/163 A |
| 4,901,637 | 2/1990 | Hagel et al. | 100/170 |
| 5,038,678 | 8/1991 | Honkala et al. | 100/170 |

FOREIGN PATENT DOCUMENTS

| | | | |
|---|---|---|---|
| 0285942 | 10/1988 | European Pat. Off. . | |
| 1811214 | 6/1970 | Fed. Rep. of Germany . | |
| 1815240 | 6/1971 | Fed. Rep. of Germany | 100/168 |
| 2410305 | 9/1975 | Fed. Rep. of Germany | 100/168 |
| 2423504 | 11/1975 | Fed. Rep. of Germany . | |
| 3713561 | 11/1988 | Fed. Rep. of Germany . | |
| 1439583 | 6/1976 | United Kingdom . | |
| 2227502 | 8/1990 | United Kingdom . | |

*Primary Examiner*—Stephen F. Gerrity
*Attorney, Agent, or Firm*—Townsend and Townsend, Khourie and Crew

[57] ABSTRACT

In a calender or roll frame, apparatus is provided for the vertical adjustment of the rolls which are journalled in bearing housings (2) and also vertically displaceably connected with the roll frame (5) via sliding supports (3) and guides (4). The connection between each sliding support and the roll frame (5) takes place via a threaded spindle (7) with a nut (8) without self-locking and also via a housing (9). The nut (8) has at its inner surface (10) a toothed arrangement (11) and the housing (5) has a further toothed arrangement (13) at its inner surface confronting the toothed end face of the nut. The nut (8) and the housing (9) can be moved relative to one another by a switching piece (14) which determines whether the toothed arrangements are meshed or disengaged. In the disengaged state the rolls can move downwards under their own weight. For the vertical adjustment of the rolls (1) a respective stroke element (6) is associated with the bearing housings (2) of the lowermost roll (1) or with the threaded spindles (7). The arrangement permits the roll spacings to be simply and rapidly increased and also restored again after exchanging one roll for a roll (1) of different diameter.

14 Claims, 2 Drawing Sheets

APPARATUS FOR THE VERTICAL ADJUSTMENT OF ROLLS

FIELD OF THE INVENTION

The invention relates to an apparatus for the vertical adjustment of rolls, in particular rolls arranged above one another in supercalenders and smoothing mills.

BACKGROUND OF THE INVENTION

In such supercalenders and smoothing mills it is for example necessary, prior to a building out of a damaged roll, to increase the spacing to the neighboring rolls and, after the building in of a new or reconditioned roll, which may among other things vary in diameter from the roll which has been built out, to reset the rolls to achieve a predetermined roll spacing. These operations must be carried out as quickly as possible.

DESCRIPTION OF RELATED ART

For this purpose use is frequently made of suspended spindles arranged at both sides which have positioning nuts for the adjustment of the roll spacings. This solution, which is described amongst other things in DE-OS 24 23 504 (GB 1 439 583), requires relatively much effort and time.

A gap adjustment device described in DE-OS 18 11 214 (U.S. Pat. No. 3,584,570) consists of hydraulic or mechanical coupling elements arranged between two adjacent bearing housings of two adjacent rolls. Blocking means are provided and the coupling elements automatically adjust themselves to the spacing of the axes on moving the rolls together. On lifting of the rolls the coupling means automatically extend by the amount of the adjustable gap height. The realization of this proposal is however associated with increased cost and effort.

PRINCIPAL OBJECT OF THE INVENTION

The invention is based on the object of providing an uncomplicated apparatus for the vertical adjustment of rolls which are arranged above one another, with the apparatus making it possible to simply and rapidly increase the roll spacings and also to restore them again after substitution of a roll which is of different diameter.

SUMMARY OF THE INVENTION

To satisfy this object there is provided a calender comprising a roll frame having left and right sides and respective generally vertically disposed guides at the left and right sides of the roll frame and a plurality of rolls arranged one above each other on the frame. Each roll has first and second ends, respective bearing housings are provided at the ends of the roll, and respective bearings are provided in the bearing housings for rotatably supporting the respective rolls. A plurality of sliding supports are mounted on the guides, with each bearing housing being connected to a respective one of the sliding supports. Threaded spindles are provided at the left and right sides of the roll frame, with each sliding support being connected to a respective one of the threaded spindles. A respective nut is mounted on each threaded spindle in respect of each sliding support, and a respective support housing surrounds each nut. Means are further provided to connect either the support housings or the threaded spindles to the roll frame. Respective first toothed means are provided on each nut and respective second toothed means are provided on each support housing confronting the respective first toothed means of the associated one of the nuts. Respective switching members are provided for each nut and its associated support housing and are movable between a first position in which the confronting first and second toothed means are in meshed engagement and a second position in which the confronting first and second toothed arrangements are disengaged. In this way, in the first position of the switching members, each nut and the associated support housing cooperate with the associated spindle to determine the vertical position of the respective sliding support in the roll frame. In the second position of the switching members each nut is able to rotate relative to and move along the associated threaded spindle under the weight of the associated roll with simultaneous movement of the roll and the associated sliding supports relative to the roll frame.

The apparatus of the invention consists of few parts and ensures the rapid and simple enlargement of the roll spacing on lowering of the stroke units or rams associated with the lowermost roll. The same effect can be achieved by lifting the threaded spindle via the corresponding stroke units, or by rotating the threaded spindles.

The basic idea can be readily understood if one considers the variant in which the rams which determine the position of the lowermost roll are lowered. On lowering the rams the rolls which lie above the roll gap to be increased are blocked from movement along the threaded spindles in the direction of the weight force by selective operation of the respective switching elements to ensure that the toothed arrangements of the associated nuts and housings are meshed. In contrast the toothed arrangements of the units and housings of the lower lying rolls, i.e., beneath the roll gap which is to be increased, are moved out of engagement so that the lower lying rolls are free to move downwardly under gravity to the extent that this is necessary. During this movement the respective nuts rotate about the threaded spindles. It will be appreciated that this situation, i.e., movement of the lower lying rolls but blocking of the movement of the higher rolls, is achieved simply via the switching pieces which determine the minimum spacing between the respective nuts and housings. If the minimum spacing between a nut and its housing is selected so that toothed arrangements are meshed then rotary movement of the nut and associated axial movement of the nut and housing along the spindle is prevented. Conversely the maximum spacing between a nut and its housing should be selected so that the toothed arrangements do not mesh with each other. Each switching piece is designed to produce movement between the respective nut and housing in the axial direction of the threaded spindle through a distance equal to the difference between the maximum and minimum spacings.

The original roll spacing is achieved after building in a roll of differing diameter in that the rolls are lifted via the stroke units of the lowermost roll or are lowered via the threaded spindles. Once the desired position of the rolls has been reached the positions of the switching pieces can be adjusted to cause intermeshing of the associated toothed gear arrangements. The associated blocking of the movement of the rolls then comes about when the stroke units of the lowermost roll are fractionally lowered after attaining a specific level, or when the threaded spindles are fractionally raised.

BRIEF DESCRIPTION OF THE DRAWINGS

The invention will now be explained in more detail with reference to two embodiments in the following. In the accompanying drawings there are shown.

DESCRIPTION OF PREFERRED EMBODIMENTS

Figure 1:
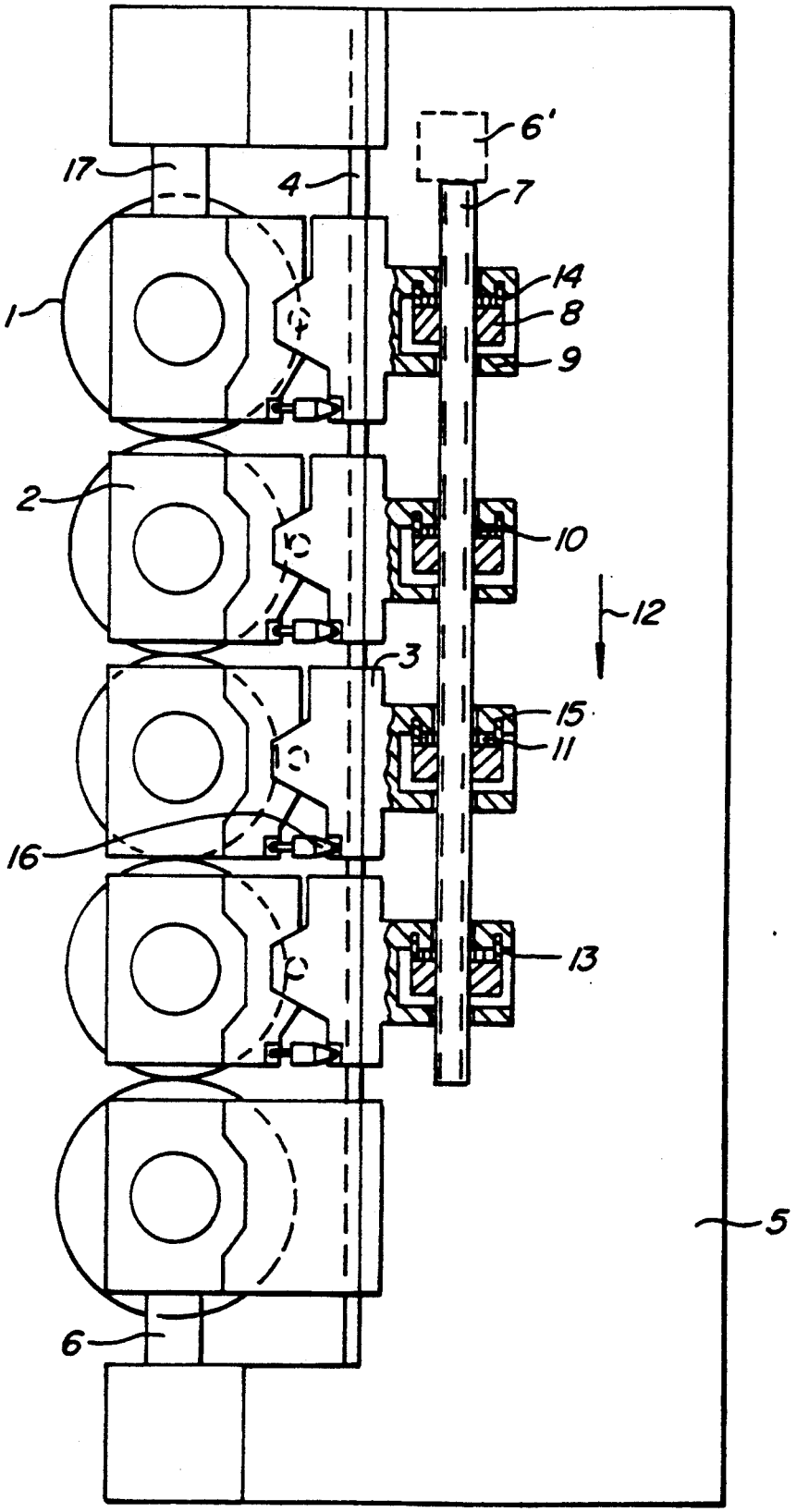
FIG. 1 a side view of a roll frame showing one embodiment of the apparatus of the invention, FIG. 2 a part sectional illustration of another embodiment, FIG. 3 a part section of a switching piece suitable for use with the embodiments of either FIGS. 1 or 2, and FIG. 4 a view of an alternative switching piece arrangement actuated by a worm drive.

The drawing of FIG. 1 shows the right-hand side of a calender comprising a plurality of rolls such as 1 supported in a roll frame 5 via bearing housings 2 and sliding supports 3. It will be understood that the left-hand side of the roll frame (not shown) is laid out in precisely the same way.

Figure 2:
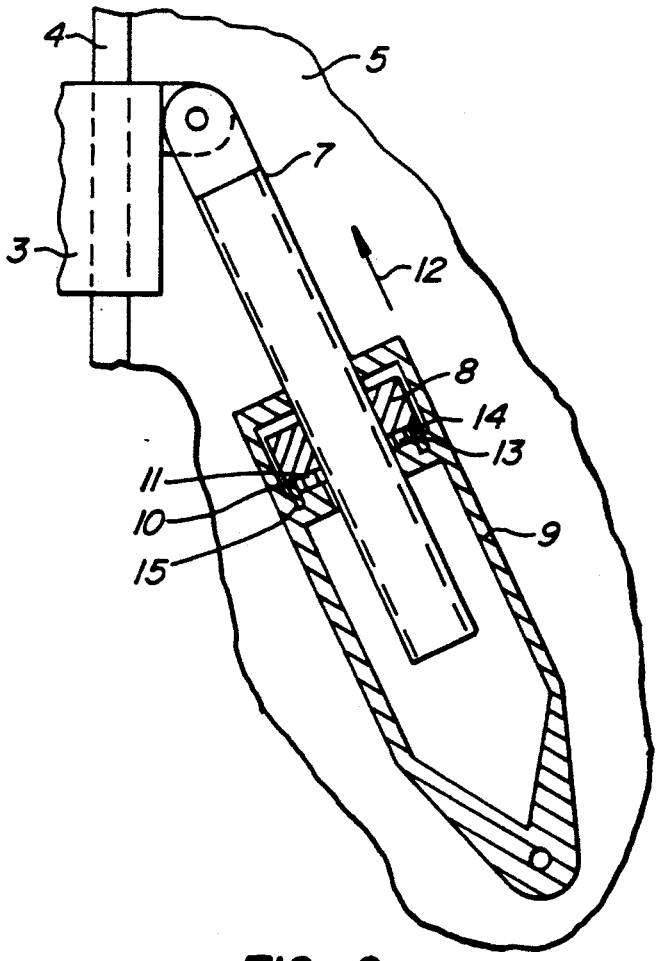

Both the embodiment of FIG. 1 and also the embodiment of FIG. 2 have in common that the rolls 1 which are arranged above one another are each journalled at both ends in respective bearing housings 2 which are vertically displaceably connected with the roll frame 5 via a respective sliding support 3 and also a guide 4. In addition each of the bearing housings of the uppermost roll 1 is acted on, i.e. loaded, in the direction of the weight force of the roll 1 by a respective stroke element 17 secured to the roll frame 5. The respective stroke elements are conveniently hydraulically operated rams or piston-in-cylinder units.

Figure 3:
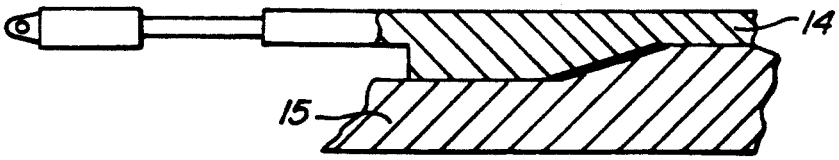
Figure 4:
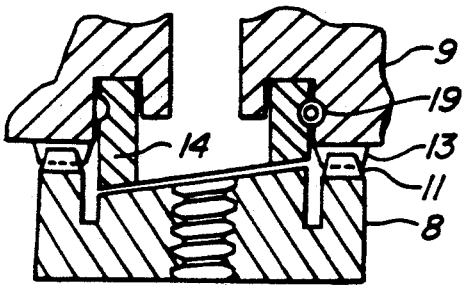

It is important that the connection between each of the sliding supports 3 and the roll frame 5 takes place via a threaded spindle 7 with a nut 8 without self-locking and also via a housing 9 which surrounds the nut 9 and part of the threaded spindle 7 while being axially displaceable thereon. In order to prevent a rotational movement of the nut 8 when loaded in the direction of the roll weight the nut has a gear arrangement 11 at the end face 10. This is the end face which faces in the opposite direction to the axial displacement direction 12 of the nut 8 when loaded by the roll weight. The housing 9 likewise has a toothed gear arrangement 13 at the inner surface confronting the toothed end face 10 of the nut 8. The toothed gear arrangement 13 meshes with the toothed gear arrangement 11 to prevent rotation and thus axial displacement of the nut 8. A movable switching piece 14 determines the minimum spacing between the nut 8 and the housing 9 and can take the form of a ring which is arranged around the threaded spindle 7 and displaceable thereon. The switching piece 14 is disposed between an inner surface of the housing and an end face of the nut which confronts this inner surface of the housing. The switching piece 14 is moreover rotatable in a defined manner about the threaded spindle 7 with the aid of a customary adjustment device. This adjustment device preferably comprises a single lever mounted on an exposed portion of the ring and actuated by a hydraulic piston-in-cylinder arrangement, as illustrated in FIG. 3. FIG. 3 shows in schematic form the cooperation between a ramp formed on the switching piece 14 and an cooperating ramp 15 formed on the housing 9. Alternatively the adjustment can for example comprise a worm drive. A worm drive can for example be realized as shown in FIG. 4 by forming the ring as a worm wheel at its cylindrical outer surface with the worm wheel meshing with an electrically or hydraulically driven worm 19. Irrespective of whether the ring is actuated by a lever or a worm drive, the relevant inner surface of the housing 9 and also at the confronting end face 15 of the ring-like switching piece 14 should be shaped in the form of two cooperating ring-like ramp surfaces, such that the switching piece 14 can be brought by rotation to a level which projects beyond the surrounding inner side surface of the housing 9. This level should be at least as large as the total tooth height of the projecting toothed arrangements 11 and 13 at the end face 10 of the nut 8 and the inner surface of the housing 9 when taken together (i.e. usually twice the tooth height). Thus, in the retracted position of the ring 14 the two toothed arrangements 11 and 13 are in meshed engagement, whereas in the extended position the toothed arrangements are disengaged, i.e. rotational movement of the nut 8 is possible.

When the toothed arrangements 11 and 13 are intermeshed the nut is blocked against rotation under the weight of the roll, i.e., against being moved in the direction of the weight force of the roll 1. The ability to switch between meshed engagement and disengagement of the toothed arrangements assumes that the spacing between the end face 10 of the nut 8 and the confronting inner surface of the housing 9 corresponds to at least the projecting heights of the two toothed arrangements 11 and 13 taken together.

In practice the toothed arrangements are relatively fine and comprise over one hundred radially oriented teeth. With a large number of smaller teeth the total adjustment stroke required to move the housing relative to the nut between the meshed and non-meshed positions of the toothed arrangements can be kept relatively small and can be realized by a relatively small angular movement of the switching ring of say 70° to 90° . It should be noted that the switching rings will normally be actuated when the rolls are supported via the rams 6 so that the actuation is not made under load whereby the actuation forces can be kept relatively small.

For the adjustment of the bearing housings 2 which are hinged to the sliding supports 3 there are provided further controllable stroke elements 16. A respective controllable stroke element 16 is provided for each bearing housing 2 and is disposed beneath the point of rotation between the bearing housing 2 and the sliding support 3. The further controllable stroke elements conveniently comprise respective piston-in-cylinder units to which hydraulic fluid can be supplied under pressure or vented to produce extension or retraction of the respective piston-in-cylinder units as necessary. The relevant hydraulic lines and connections will be well understood and are not shown in the drawing for the sake of simplicity. The function of the elements 16 is the compensation of overhung loads which, if not compensated, would lead to excessive bending of the rolls and lowering of their ends which has undesirable effects on the nip lines between adjacent rollers.

Characteristic for the embodiment shown in FIG. 1 is the fact that the sliding supports or carriages 3 are fixedly connected with the associated housings 9, and that the nuts 8 are respectively jointly arranged on a threaded spindle 7 secured to the roll frame 5. As indicated earlier there are in fact two threaded spindles one at each side of the roll frame.

The vertical adjustment of the rolls 1 can be effected via stroke units 6 associated with the bearing housings 2 of the lowermost roll 1 or alternatively or additionally via respective stroke units 6' which bring about the vertical displacement of the two threaded spindles 7. An embodiment is also conceivable in which the spindles are rotated. In this case the stroke units 6' would be replaced by a hydraulic or electric motor.

The embodiment illustrated in FIG. 2 relates to an adjustment mechanism for just one sliding support 3. It will be understood that a plurality of such adjustment mechanisms are provided for each of the relevant sliding supports. In the illustrated embodiment the sliding support 3 is pivotally connected with the corresponding threaded spindle 7 and the housing 9 is separate from the sliding support. In fact it is pivotally connected with the roll frame 5. Again a respective stroke unit 6 is associated with each of the bearing housings 2 of the lowermost roll 1.

As can be seen from the use of the same reference numerals as are used in FIG. 1 the housing 9 is again provided with a toothed arrangement 13 (this being provided on a partition wall of the housing) which meshes with the arrangement 11 at the end face of the nut 8. Again a ring is provided to move the nut 8 from a position in which the toothed arrangements mesh to a position in which they are disengaged. The operation of the arrangement of FIG. 2 takes place analogously to that of FIG. 1. That is to say when the toothed arrangements 11 and 13 are disengaged the nut 8 can rotate under the weight load of the roll or rolls so that the relative position of the nut and spindle are changed and the associated roll is lowered. Conversely on extending the associated stroke units 6 the associated roll will be lifted.

It should be pointed out that the bottommost and uppermost rolls can readily be realized as NIPCO (registered trademark) rolls, for example as described in the Tappi Journal, Vol. 72, No. 7, July 1989 from pages 95 to 102. NIPCO is a trademark of the present applicant. A NIPCO roll basically comprises a shell surrounding a beam with the beam including a plurality of hydrostatic pistons distributed cross the beam and acting on the roll shell from the inside. The pistons are grouped into a plurality of zones and in each zone different oil pressures can be applied so that different forces act on the shell in the cross machine direction. This provides control of roll deformation and shaping of the line force profile. In such NIPCO rolls the beams do not rotate. Accordingly they do not have to be mounted at their ends in rotary bearings. This means that if a NIPCO roll is used as the lowermost roll in say the FIG. 1 embodiment of the present application, then, strictly speaking, a bearing housing is not necessary for each end of this roll.

The operation of the calender of the present invention with respect to the changing of a roll will now be explained further with reference to FIG. 1.

It will be noted that FIG. 1 shows five rolls arranged vertically above one another. In practice there are frequently more rolls, for example calenders have been built having 16 rolls, and the individual rolls can be very heavy, for example up to 25 tons each. For the purpose of the present explanation it will be assumed that the central one of the five illustrated rolls of FIG. 1 is to be exchanged.

The first step in this case is to actuate the switching members 14 for the central roll and the roll immediately below it so that the respective toothed arrangements move out of engagement with one another. The toothed arrangements for the two rolls above the central roll however remain in engagement. Once the toothed arrangements for the central roll and the roll beneath it have been released the rams 6 can be lowered partially. This means that the central roll will move away from the roll immediately above it, thus producing a gap between these two rolls. The central roll still rests however on the roll immediately below it which in turn rests on the bottommost roll. The toothed arrangements at the left-and right-hand sides of the center roll are now reengaged and the rams 6 are now lowered further. Because the toothed arrangements for the center roll are meshed the nut cannot rotate under the weight of the roll and therefore the associated sliding supports 3 cannot slide downwardly.

In contrast the nuts 8 with toothed arrangements for the roll immediately beneath the center roll are disengaged; therefore the respective nuts can turn under the weight load of the respective roll. Thus on further lowering of the rams 6 the roll immediately below the center roll and the lowermost roll are jointly lowered producing a gap beneath the center roll. The center roll can now be exchanged for another roll, optionally another roll having a different diameter.

If the roll to be substituted has a larger diameter than the center roll, then the extent of lowering must be selected in such a way that there is adequate space for the insertion of the new roll. Clearly this is not such a problem if the new roll has a smaller diameter. Having inserted the new roll the ram 6 can be extended again so that the two bottommost rolls move upwardly and contact the new center roll. At this stage the operation of the rams 6 is halted, the switching member for the center roll is disengaged and the center roll and the roll immediately beneath it as well as the bottom roll are moved upwardly by further extension of the rams 6 until contact is reestablished with the roll immediately above the center roll. During upward movement of the bottommost rolls the nuts are again caused to turn on the threaded spindles 7 this time under the hydraulic load of the rams 6.

If hydraulic piston-in-cylinder units 17 are provided for loading the roll stack then these would normally be raised prior to lowering the hydraulic rams 6. In order to raise the hydraulic rams 17 it is necessary to actuate the switching members for the toothed arrangements associated with the topmost roll to separate these toothed arrangements.

If hydraulic piston-in-cylinder units 17 are used for loading the roll stack then the hydraulic piston-in-cylinder units 6 are first fully extended so that the rams move against an abutment and all upper lying rolls, with the exception of the topmost roll, which is lifted out of the way by the hydraulic piston-in-cylinder unit 17, are then in their highest position. The rams 6 can then be backed off slightly to provide the requisite gaps between the rolls. Thereafter the hydraulic piston-in-cylinder units 17 are actuated (with the switching members for the toothed arrangements associated with the topmost roll being out of engagement) so that the topmost roll is pushed against the roll stack and applies the desired operating loads to the stack of rolls. Once the topmost roll has reached its desired operating position the respective switching members can be actuated so that the respective toothed engagements associated with the sliding supports for the topmost roll are reengaged.

Clearly, the same manner of operation can be achieved if the hydraulic piston-in-cylinder units 6' are used to raise or lower the threaded spindles 7 rather than lowering the bottommost roll via the hydraulic rams 6. An analogous mode of operation would also be possible if the threaded spindles 7 are rotated rather than lifted.

From the foregoing description it will be appreciated that the individual switching members 14 must be actuated separately or in pairs (each pair being associated with one roll) to permit the desired interchange of any rolls of a stack.

The equivalent operation is also possible with a roll stack incorporating the embodiment of FIG. 2.

What is claimed is:

1. A calender comprising a roll frame having left and right sides and respective generally vertically disposed guides at said left and right sides of said roll frame, a plurality of rolls arranged one above each other on said frame, each said roll having first and second ends, respective bearing housings at the ends of said rolls, respective bearings provided in said bearing housings for rotatably supporting the respective rolls, a plurality of sliding supports mounted on said guides, with each said bearing housing being connected to a respective one of said sliding supports, threaded spindles provided at said left and right sides of said roll frame, with each said sliding support being connected to a respective one of said threaded spindles, a respective nut mounted on each threaded spindle in respect of each said sliding support, and a respective support housing surrounding each said nut; means connecting one of said support housings and said threaded spindles to said roll frame, respective first toothed means provided on each said nut, respective second toothed means provided on each support housing confronting the respective first toothed means of the associated one of said nuts, and respective switching members provided for each said nut and its associated support housing and movable between a first position in which the confronting first and second toothed means are in meshed engagement and a second position in which said confronting first and second toothed arrangements are disengaged, whereby, in said first position of said switching members, each said nut and the associated support housing cooperate with the associated spindle to determine a vertical position of the respective sliding support in the roll frame and in said second position of said switching members each said nut is able to rotate relative to and move along the associated threaded spindle under the weight of the associated roll with simultaneous movement of said roll and the associated sliding supports relative to said roll frame.

2. A calender in accordance with claim 1 wherein each said support housing is fixedly connected to the associated one of said sliding supports and wherein the associated threaded spindle is mounted on said roll frame.

3. A calender in accordance with claim 2 wherein first and second threaded spindles are respectively provided one at each of said left and right sides of said roll frame and are connected thereto.

4. A calender in accordance with claim 3 wherein each said threaded spindle is directly connected to said roll frame.

5. A calender in accordance with claim 3 wherein each said threaded spindle is indirectly connected to said roll frame and wherein a respective piston-in-cylinder unit is provided between said each threaded spindle and said roll frame.

6. A calender in accordance with claim 1 wherein said plurality of rolls comprises a bottommost roll and wherein piston-in-cylinder means is provided between said bottommost roll and said roll frame for lifting said bottommost roll.

7. A calender in accordance with claim 1 wherein piston-in-cylinder means is provided between each threaded spindle and said roll frame for raising and lowering said threaded spindle.

8. A calender in accordance with claim 1 wherein each sliding support is pivotally connected to a respective threaded spindle, and the associated support housing is pivotally connected to said roll frame.

9. A calender in accordance with claim 8 wherein said plurality of rolls comprises a bottommost roll and wherein piston-in-cylinder means is provided between a bottommost roll and said roll frame for lifting said bottommost roll.

10. A calender in accordance with claim 1 wherein said plurality of rolls comprises an uppermost roll and wherein hydraulic loading means is provided for exerting a downward load on said uppermost roll.

11. A calender in accordance with claim 1 wherein each said bearing housing is pivotally connected to the associated one of said sliding supports and an extensible and retractable piston-in-cylinder unit is disposed between each said bearing housing and the associated one of said sliding supports for the adjustment of a pivotal position of each said bearing housing relative to the associated one of said sliding supports.

12. A calender in accordance with claim 1 wherein each said switching member comprises a ring member rotatable about the associated threaded spindle and having a ramp surface cooperating with a mating ramp surface on at least one of said housing and said nut to produce relative axial movement therebetween relative to said threaded spindle thereby producing, in dependence on the direction of relative axial movement, engagement and disengagement of said first and second toothed means.

13. A calender in accordance with claim 12 wherein said ring is actuated from a power source via a lever.

14. A calender in accordance with claim 12 wherein said ring is provided with worm gear teeth and is actuatable for rotation around said spindle by a respective drive worm.

* * * * *